US007914302B1

(12) United States Patent
Zhu

(10) Patent No.: US 7,914,302 B1
(45) Date of Patent: Mar. 29, 2011

(54) HIGH FREQUENCY ELECTRICAL CONNECTOR

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/832,036

(22) Filed: Jul. 7, 2010

(30) Foreign Application Priority Data

Nov. 24, 2009 (CH) ..... 2009 2 0315542

(51) Int. Cl.
*H01R 12/00* (2006.01)

(52) U.S. Cl. ..... 439/79; 439/872

(58) Field of Classification Search ..... 439/79, 439/101, 540.1, 637, 701, 869, 871, 872
See application file for complete search history.

(56) References Cited

U.S. PATENT DOCUMENTS 6,322,377 B2 * 11/2001 Middlehurst et al. ..... 439/79
7,726,982 B2 * 6/2010 Ngo ..... 439/79
7,762,857 B2 * 7/2010 Ngo et al. ..... 439/856
7,775,822 B2 * 8/2010 Ngo et al. ..... 439/290

* cited by examiner

*Primary Examiner* — Khiem Nguyen
(74) *Attorney, Agent, or Firm* — Wei Te Chung; Andrew C. Cheng; Ming Chieh Chang

(57) ABSTRACT

An electrical connector assembly has an elongated insulative housing and a plurality of signal contacts secured in corresponding passageways defined in the housing. Each signal contact has a retention portion retained in the passageway, a contact portion extending from the retention portion and a soldering portion extending from the retention portion. The contact portion defines a first face exposing an exterior of the passageways and a second face opposite to the first face. Wherein each of signal contacts defines a recess on the second face. The signal contacts become thinner so as to prevent signal contacts from crosstalk and improve high frequency performance.

9 Claims, 8 Drawing Sheets

HIGH FREQUENCY ELECTRICAL CONNECTOR

BACKGROUND OF THE INVENTION

1. Field of the Invention

The present invention generally relates to an electrical connector, and more particularly, to a novel structure of an electrical connector with an improved high frequency performance.

2. Description of Related Art

The usage of electrical connectors with high frequency performance has increased. The undesired signal or loss of signal strength in high frequency electrical connectors become much more frequently. For example, an electrical connector with high frequency signal transmission includes an insulative housing and a plurality of contacts disposed in a plurality of passageways of the insulative housing. Because of electromagnetic wave between each two adjacent contacts, the two contacts are easy to cause undesired signal and crosstalk. When high frequency signals transmit, signals become much weak and electrical connectors can not work normally or cause dummy signal. Thus, an electrical connector with improved high frequency performance is desired to overcome the disadvantages of the related art.

Hence, the present invention is directed to solving this problem in the related art.

SUMMARY OF THE INVENTION

An object of the invention is to provide an electrical connector with new contacts to improve high frequency performance thereof.

In order to achieve the object set forth, an electrical connector assembly has an elongated insulative housing and a plurality of signal contacts secured in corresponding passageways defined in the housing. Each signal contact has a retention portion retained in the passageway, a contact portion extending from the retention portion and a soldering portion extending from the retention portion. The contact portion defines a first face exposing an exterior of the passageways and a second face opposite to the first face. Wherein each of signal contacts defines a recess on the second face. The signal contacts become thinner so as to prevent signal contacts from crosstalk and improve high frequency performance.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
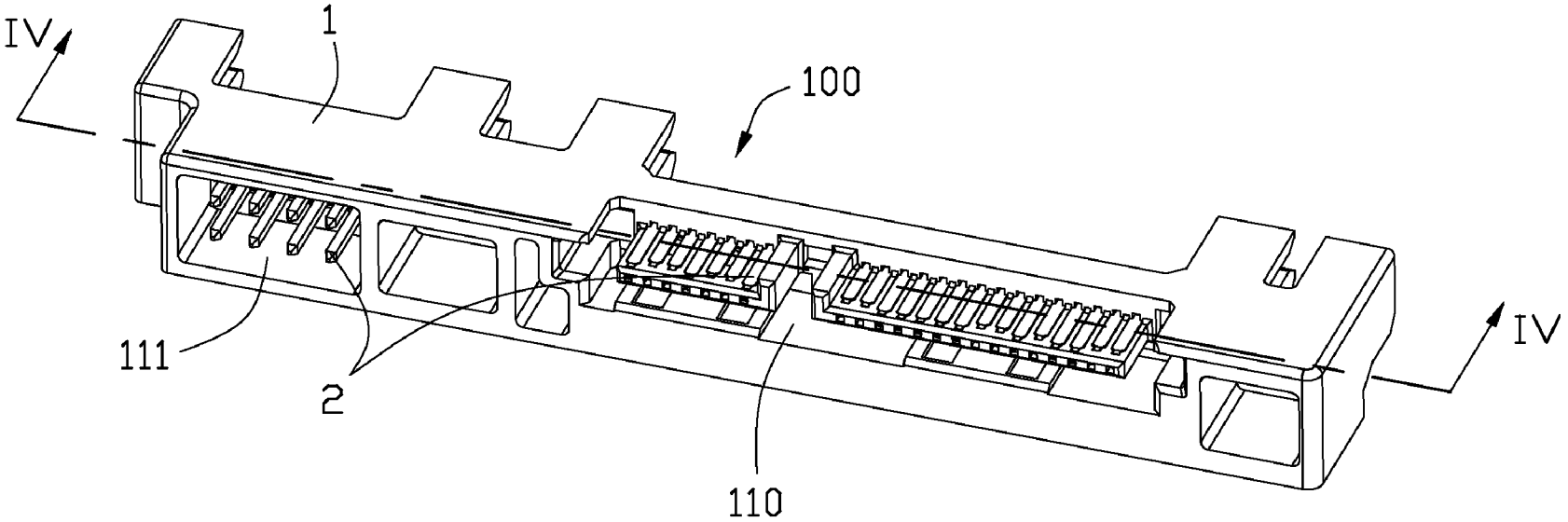
FIG. 1 is an assembled perspective view of an electrical connector of an embodiment of the present invention.

Referring to FIG. 1, an electrical connector 100 of the present invention is accordance with a Serial Advanced Technology Attachment (SATA) standard. The electrical connector 100 comprises an insulative housing 1 defining two mating ports 110, 111 with a plurality of contact 2 in the mating ports 110, 111.

Figure 2:
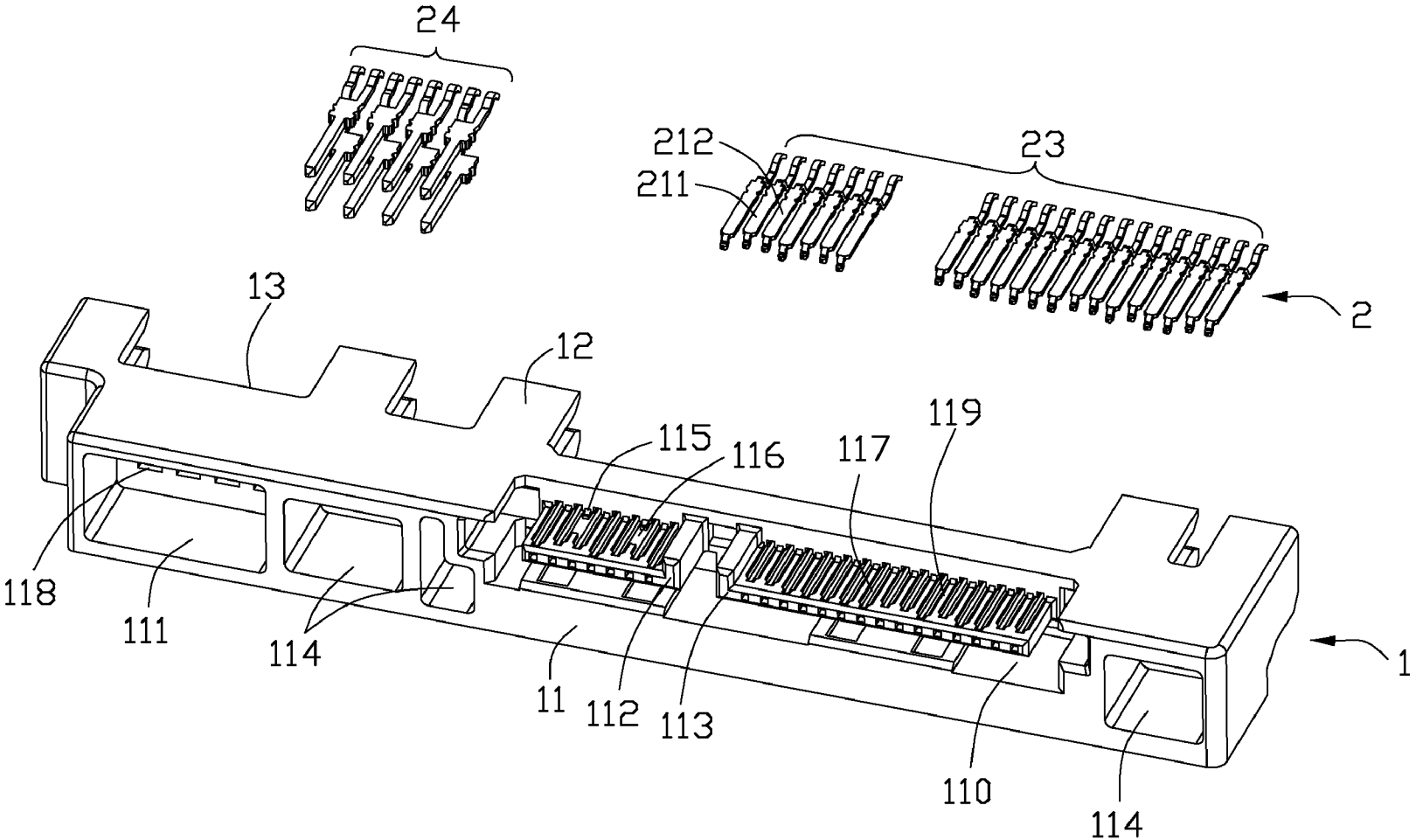
FIG. 2 is an exploded perspective view of the electrical connector as shown in FIG. 1.

Referring to FIGS. 1 and 2, the insulative housing 1 is substantially elongated and integrally formed which has a front mating face 11 for confronting with a complementary connector (not shown), a rear face 13 opposite to the front mating face 11 and a top face 12 perpendicular to the mating face 11. The first mating port 110 extends between the mating face 11 and the rear face 13 and opens upwardly and forwardly. The first mating port 110 defines two similar L-shaped tongue portions 112,113 side by side extending forwardly parallel to the top face 12. The second mating port 111 extends between the mating face 11 and the rear end face 13 and opens forwardly. Two cavities 114 between the two mating ports 110, 111 and one cavity 114 at opposite side of the first mating port 110 are provided extending forwardly for auxiliary guidance such as receiving guiding posts (not shown) of the complementary connector.

Referring to FIG. 2, the first mating port 110 includes a plurality of first passageways 117 extending on the top face of the tongue portions 112,113 and through the front mating face 11 and the rear face 13 to receive first contacts 23. The first contacts of similar construction are divided into two rows respectively on two tongue portions and each includes a flat contact portion 202 retained in the first passageways 117. The first tongue portion 112 is shorter than the second tongue portion 113 in the longitudinal direction of the connector. The first and second tongue portion 112, 113 all define a separator 119 between each two adjacent first passageways 117.

Figure 3:
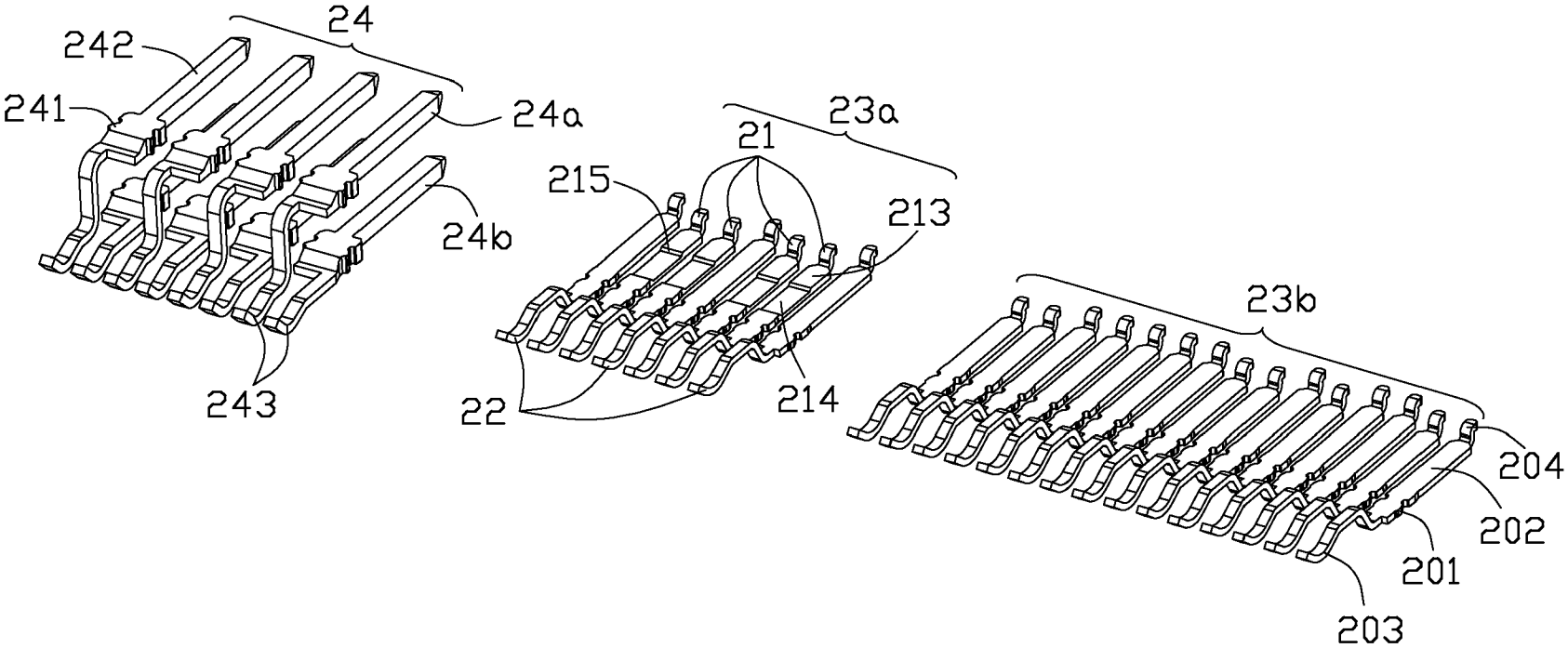
FIG. 3 is a perspective view of all the contacts of the electrical connector as shown in FIG. 1.
Figure 4:
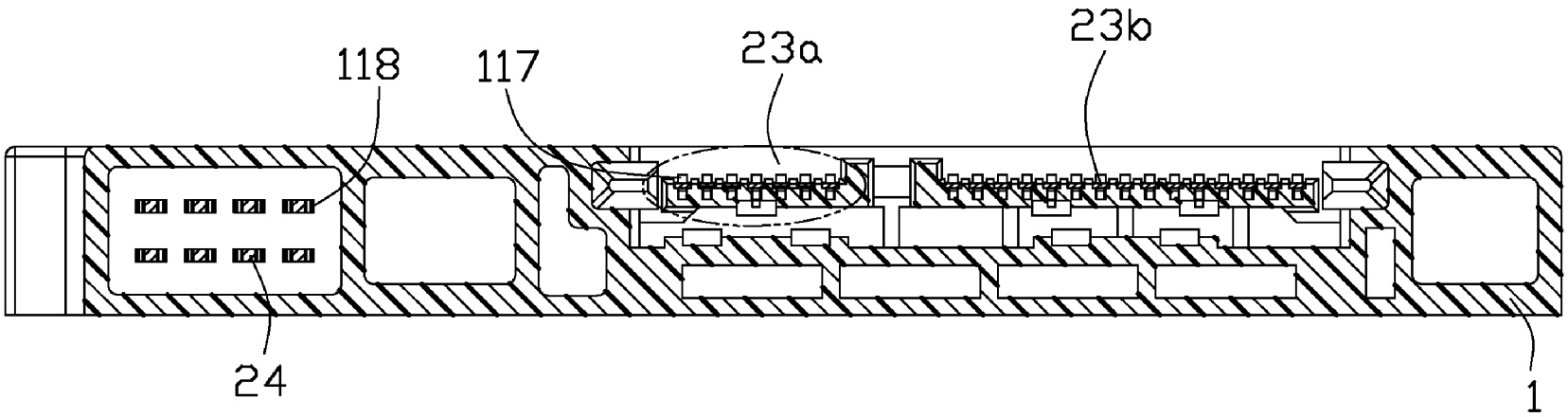
FIG. 4 is a cross-sectional view of the electrical connector taken along lines 4-4 in FIG. 1.

Referring to FIG. 3, said first contacts 23 retained in the first passageway 117 are of similar construction, each includes a retention portion 201 secured in the first passageway 117, a flat contact portion 202 extending from one end of the retention portion 201 in the passageway 117 and a soldering portion 203 extending from the other end of the retention portion 201 outside the rear face 13. The soldering portions 203 of the contacts can be jointed elastically on the circuit board (not shown). The free end of the contacting portion 202 bending to receive in the tongue portion 112, 113 forms as an abutting end 204. The first contacts include a first contact group 23*a* for signal transmission with seven pieces secured on the first tongue portion 112 and a second contact group 23*b* for power transmission with fifteen pieces secured on the second tongue portion 113. The first contact group 23*a* includes two pair of differential signal contacts 21 and three grounding contacts 22 arranged in an alternating sequence.

Figure 5:
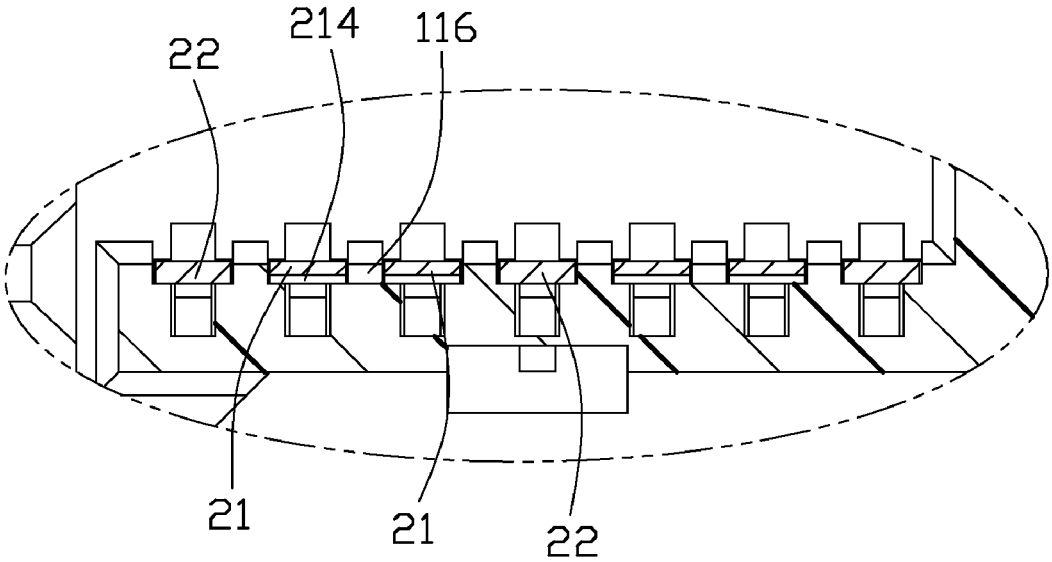
FIG. 5 is a partly-enlarged view of the electrical connector as shown in FIG. 4.

Please note the differential contacts 21 further define hollow recesses 214 thereon to meet the requirement of high frequency performance. The contact portion 211 of the signal contact 21 defines a first face 212 labeled in FIG. 2 on a same side of the top face of the tongue portions for contacting the complementary connector and a second face 213 opposite to the first face 212 and confronting with inner face of the first passageway 117. The recess 214 is defined on the second face 213 and runs through the signal contact in a wide direction of the contact, i.e., the longitudinal direction. A step 215 is formed by the recess 214 and the second face 213. The recesses 214 are located between the retention portion 201 and the abutting end 204 of the contacts 21. As best shown in FIG. 5, when the signal contacts 21 are assembled in the first passageways 117, the recess 214 faces to and separates from the first passageway 117 with a distance. Each separator 115 between the pair of signal contacts defines a recess 116 corresponding to the slot 214 and communicating with the first passageways 117 at the two sides of the recess 116. The signal contacts 21 become thinner so as to prevent the signal from cross talk. The recess 116 defined on the separator 115 between the two signal contacts 21 is for changing dielectric constant so as to improve high frequency performance.

Referring to FIGS. 2 to 3, the second mating port 111 includes a plurality of second passageways 118 running through the rear face 13 and communicating with the second mating port 111 and a plurality of test contacts 24 grouped into two rows 24*a*, 24*b* in up to down direction and retained in the second passageways 118. Each of the test contacts has a retention portion 241, a pin contact portion 242 extends from the front end of the retention portion 241, and a soldering portion 243 extends from the other end of the retention portion 241. The soldering portions 241 of the upper row 24*a* of the test contact 24 and the other row 24*b* are arranged in an alternating sequence at one same line and mounted on the circuit board at the same time. So as it can save space of the circuit board.

Figure 6:
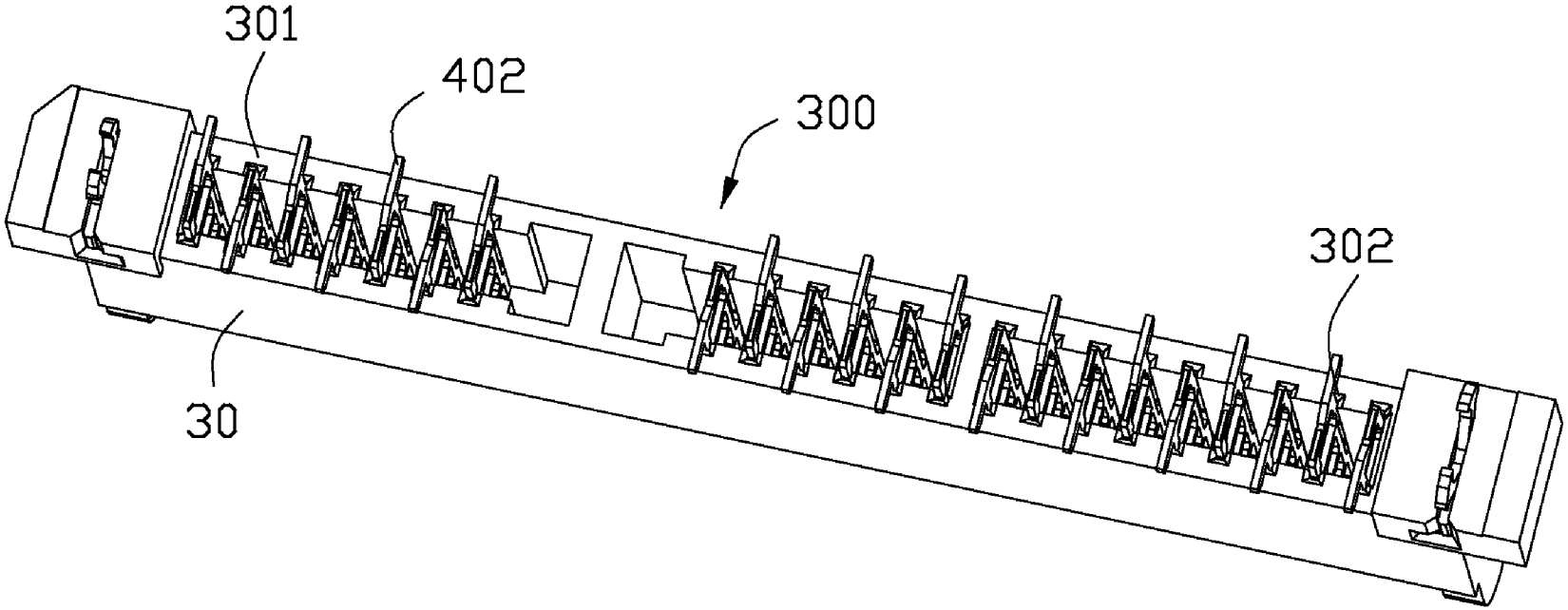
FIG. 6 is an assembled perspective view of an electrical connector of another embodiment of the present invention.
Figure 7:
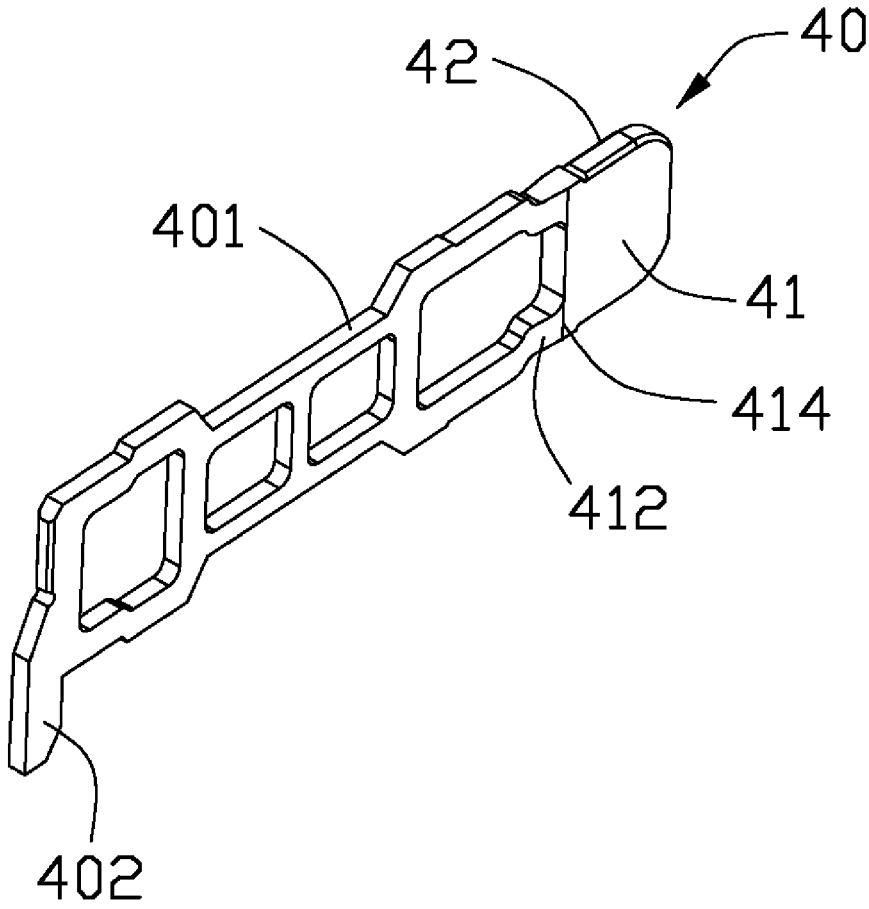
FIG. 7 is a perspective view of a contact of the electrical connector as shown in FIG. 6.
Figure 8:
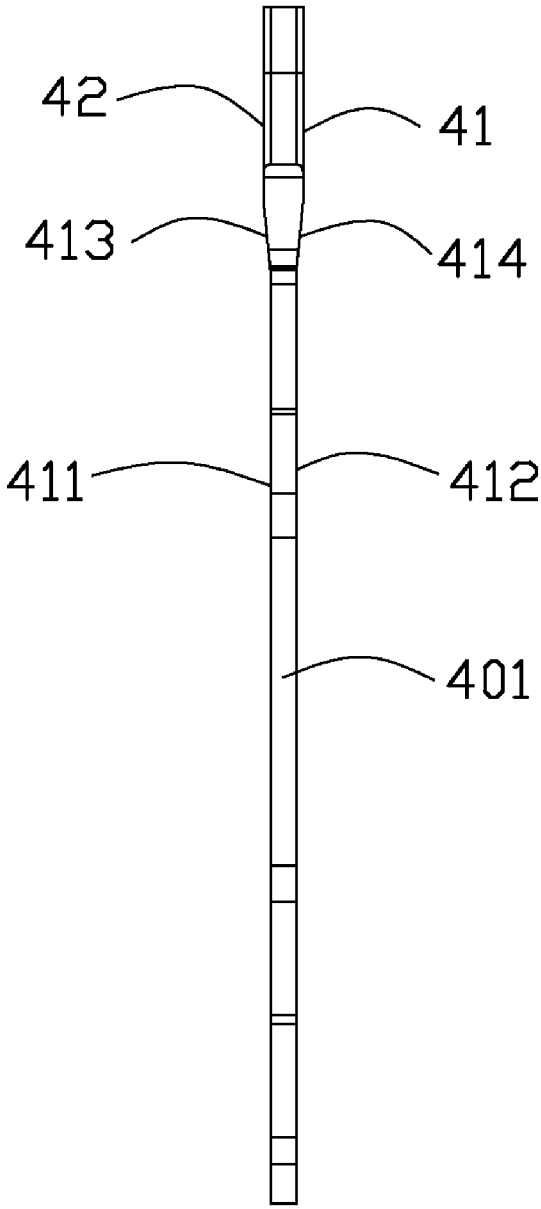
FIG. 8 is a side elevational view of the contact of the electrical connector as shown in FIG. 7.

Referring to FIGS. 6 to 7, another preferred embodiment of the electrical connector 300 comprises an longitudinal insulative housing 30 defining a mating face for confronting with a complementary connector (not shown) and a rear face 301 for mounting on a circuit board (not shown) opposite to the mating face. A plurality of terminal receiving passageways 302 extend through the mating face and the rear face 301. Each two adjacent terminal receiving passageways 302 are communicated with each other.

A plurality of contacts 40 are blade-shape and secured in the terminal receiving passageways 302. Each contact 40 has a main body 401 defining a first face 41 and a second face 42 opposite to the first face 41 for contacting the complementary connector. The main body 401 defines a first recess 411 and a second recess 412 opposite to the first recess 411 respectively on the second face 42 and the first face 41. A first step 413 is defined by the first recess 411 and the second face 42, and a second step 414 is defined by the second recess 412 and the first face 41. The contact 40 has a soldering portion 402 extending rearward from the main body 401 outside the rear end face 301. The soldering portions 402 of each two adjacent contacts 40 extend in opposite directions with each other and arrange in an alternating sequence with the insulative housing 30. The first recess 411 of the contact 40 and the second recess 412 of the adjacent contact 40 are face to face with each other. In the embodiment the contacts defining the first and second recess 411, 412 at opposite sides thereof are for changing the thickness of the contacts in contacts arranging direction so as to improve high frequency performance.

What is claimed is:

1. An electrical connector, comprising: an insulative housing is substantially elongated and integrally formed, and loaded with a plurality of signal contacts in corresponding passageways defined in the insulative housing; each signal contact comprising a retention portion secured in the insulative housing, a contact portion extending from the retention portion and a soldering portion extending from the retention portion, the contact portion defining a first face exposing an exterior of the passageways and a second face opposite to the first face and confronting with an inner side of the passageway; wherein each of signal contact defines a recess in the second face, wherein said recess runs through the signal contact in a wide direction of the contact, wherein said insulative housing has a mating port for receiving a complementary connector and the mating port defines a tongue portion therein, the electrical connector comprises pairs of signal contacts and individual ground contacts arranged in an alternating sequence on the tongue portion, wherein said tongue portion defines a separator between each two adjacent contacts, the separator between the pair of signal contacts defines a recess corresponding to the recess of the signal contact and communicating with the passageways at the two sides of the recess, wherein said recess faces to and separates from the passageway with a distance.

2. The electrical connector as claimed in claim 1, wherein said insulative housing includes another mating port to receiving a plurality of test contacts.

3. The electrical connector as claimed in claim 2, wherein said test contacts are arranged in two rows and soldering portions of test contacts are arranged at one same line.

4. The electrical connector as claimed in claim 1, wherein each of said signal contacts defines a second recess opposite to the slot on the first face.

5. An electrical connector comprising: an insulative housing defining a mating port with a mating tongue exposed therein, a plurality of grooves extending, along a front-to-back direction, in and under a mating face of the mating tongue; and a plurality of contacts disposed in the housing, each of said contacts including a mating section received in the corresponding groove, said mating section defining an outer face away from the mating face of the mating tongue and slightly above the mating face in a vertical direction perpendicular to said front-to-back direction for engagement with a complementary contact of a counterpart connector; wherein a recess is formed in the mating section of each of the contacts and hidden under the outer face under condition that said recess extends through at least one side edge of said mating section in a lateral direction perpendicular to said vertical direction and said front-to-back direction so as to optimize electrical characters of the contact, wherein the mating section of each of said contacts defines an inner face opposite to the outer face, and the recess extends through the inner face to confront the groove in said vertical direction, wherein the mating tongue defines on the mating face a plurality of separators each dividing two corresponding neighboring grooves by two sides, and some of said separators define recessions each communicating with the corresponding recess in said lateral direction, wherein the outer face of the mating section of each of the contacts is planar, and a thickness of the mating section around the recess is thinner than those around other portions of the mating section of each of the contacts.

6. The electrical connector as claimed in claim 5, wherein said recess is formed only in the contact which is for signal transmission.

7. The electrical connector as claimed in claim 6, wherein the contacts having the recesses therein are differential pairs communicating with each other via the corresponding recession in the lateral direction.

8. The electrical connector as claimed in claim 5, wherein the recession of the separator defines a bottom face which is essentially coplanar with another bottom face defined in the correspond groove beside said separator.

9. An electrical connector comprising: an insulative housing defining a mating port with a mating tongue exposed therein, a plurality of grooves extending, along a front-to-back direction, in and under a mating face of the mating tongue; and a plurality of contacts disposed in the housing, each of said contacts including a mating section received in the corresponding groove, said mating section defining an outer face away from the mating face of the mating tongue and slightly above the mating face in a vertical direction perpendicular to said front-to-back direction for engagement with a complementary contact of a counterpart connector; and a plurality of separators formed on the mating face of the mating tongue, each of said separators dividing the corresponding two neighboring grooves by two sides thereof; wherein a recession is formed in each of some separators and exposed to an exterior in the vertical direction and further communicates with the mating sections of the corresponding two neighboring contacts in said corresponding two neighboring grooves, respectively, in a lateral direction perpendicular to said vertical direction and said front-to-back direction so as to optimize electrical characters of the contact, wherein the contacts communicating with the corresponding recessions, are equipped with recesses aligned with the corresponding recessions, in said lateral direction, wherein the recess is formed in an inner face of the mating section of the contact while an outer face of the mating section keeps planar.

* * * * *